US006000644A

United States Patent [19]

Musschoot

[11] Patent Number: 6,000,644

[45] Date of Patent: Dec. 14, 1999

[54] METHOD AND APPARATUS FOR RECLAIMING FOUNDRY SAND

[75] Inventor: Albert Musschoot, Barrington, Ill.

[73] Assignee: General Kinematics Corporation, Barrington, Ill.

[21] Appl. No.: 08/903,712

[22] Filed: Jul. 31, 1997

[51] Int. Cl.[6] ..... B02C 19/12

[52] U.S. Cl. ..... 241/39; 164/5; 241/65; 241/DIG. 10

[58] Field of Search ..... 241/DIG. 10, 5, 241/82, 39, 23, 65; 164/5, 412; 366/107, 128

[56] References Cited

U.S. PATENT DOCUMENTS

| | | | |
|---|---|---|---|
| 3,989,227 | 11/1976 | Musschoot | 366/107 |
| 4,978,076 | 12/1990 | Andrews et al. . | |
| 5,044,567 | 9/1991 | Hte et al. | 241/82 |
| 5,217,170 | 6/1993 | Reier . | |
| 5,251,684 | 10/1993 | Andrews et al. . | |
| 5,289,920 | 3/1994 | Godderidge et al. | 241/DIG. 10 |

FOREIGN PATENT DOCUMENTS

| | | | |
|---|---|---|---|
| 3226049 | 1/1984 | Germany | 241/DIG. 10 |

*Primary Examiner*—Mark Rosenbaum
*Attorney, Agent, or Firm*—Wood, Phillips, VanSanten, Clark & Mortimer

[57] ABSTRACT

Inefficiencies in reclaiming foundry sand from foundry cores made up of sand and an organic resin binder are reduced in a method of reclaiming such sand that includes the steps of reducing a foundry core made up of sand and an organic resin binder to small clumps or individual particles, placing the small clumps or individual particles in a bed and introducing a heated gaseous oxidant into the bed generally from the bottom thereof in sufficient volume to fluidize the bed and at sufficient temperature to oxidize the resin binder on the small clumps or individual particles. Also disclosed is an apparatus for performing the method.

7 Claims, 3 Drawing Sheets

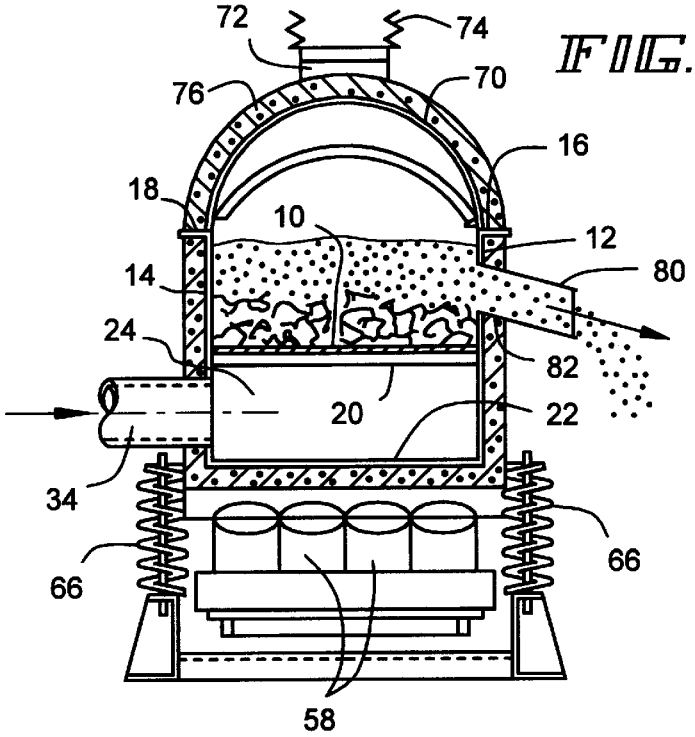
FIG. 2
FIG. 3
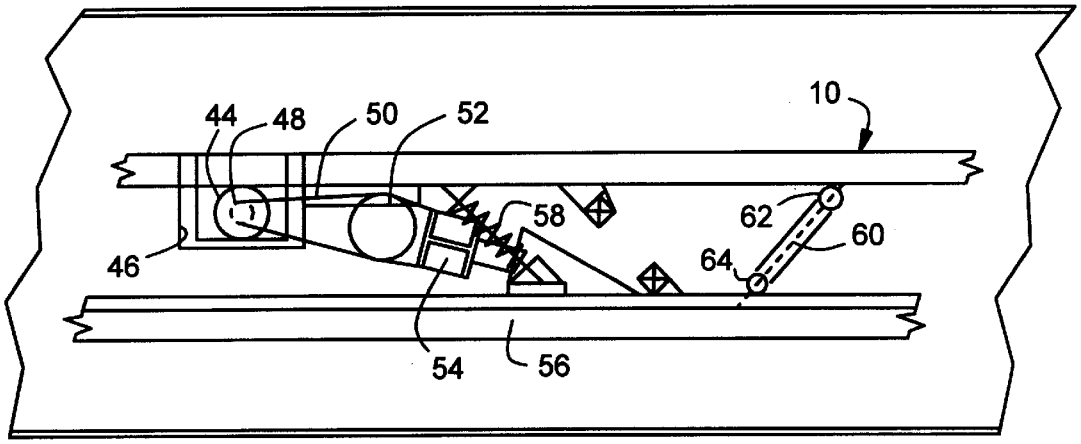

METHOD AND APPARATUS FOR RECLAIMING FOUNDRY SAND

FIELD OF THE INVENTION

This invention relates to the reclaiming of foundry sand employed in the making of foundry cores using sand and organic resin binder. More specifically, the invention relates to a method of reclaiming foundry sand by removal of the resin from the sand particles.

BACKGROUND OF THE INVENTION

Sand has long been used in foundry operations in making cores. The cores are employed in a casting process to ultimately provide voids in the casting. The cores are shaped so as to provide a void of a desired size and shape and to serve this purpose, it is necessary that the cores retain their integrity through the casting process until the molten metal employed in the casting process has solidified. When that occurs, the core is then broken up typically in a so-called "shake out" process, leaving a void of the desired size and shape within the casting.

To assure that the sand cores retain their desired size and shape during the casting process and yet can be broken up relatively easily to separate from the casting resulting from the process, it has been conventional to employ various organic resins as a binder to bind the grains of sand together to provide the structural integrity required. Although the amount of binder employed may vary depending upon the type of resin used, it is fairly typical to employ a resin content of about 2%, particularly in the so-called phenolic ester nobake process. Other foundry binder system include phenolic urethane coldbox, furan nobake, phenolic urethane nobake, and phenolic hotbox.

While these resins work well for their intended purpose, at the conclusion of the casting process, following shake out, a resin residue remains on the grains of sand and/or the sand may be in clumps, still held together by the binder. Whereas in the past, such sand was simply disposed of, environmental concerns have strongly suggested that the sand be reused wherever possible. Unfortunately, the presence of spent resin binder on the sand makes it impossible to use the same effectively and efficiently without first removing the resin residue.

To accomplish reclamation of the sand, one system proposed includes an indirectly heated rotary kiln, a rotary sand cooler, a pneumatic scrubber and classifier, a second rotary kiln, a second rotary sand cooler, and a second pneumatic scrubber and classifier. Shake out sand and other sand containing resin that results from the foundry operation, including the formation of the cores, is first reduced to small clumps or individual particles using a vibratory crusher. The sand may then be run through a magnetic separator to remove so called "tramp" metal and then is transported to the first kiln. The kiln is basically a drum including internal lifter bars which run lengthwise and lift the sand and carry it from the bottom of the drum to near the top where the sand then falls off of the lifter bar and tumbles through the interior of the drum which is provided with hot air from a heater. The hot air may be 1,250° F. or more and as a consequence, the oxygen in the air and the heat act to combust the resin on the sand. Such residue as remains is dried and embrittled so that it can be scrubbed from the sand grains in the first scrubber/classifier. This process is essentially repeated in the second set of kiln, cooler and scrubber/classifier and the result is sand that has been reclaimed to the quality needed for reuse in resin binder systems.

While the system is operative to achieve its intended purpose, it is unnecessarily complex, and therefore, expensive. Furthermore, because heat transfer to the sand is achieved basically only by the heated air and/or contact of the sand grains with a heated drum, it is relatively slow and residence time is undesirably long. This in turn results in relatively large equipment in order to process a given quantity of sand to be reclaimed over a given time period. And, of course, the large equipment necessitates an undesirably large amount of floor space to house the same.

The present invention is directed to overcoming one or more of the above problems.

SUMMARY OF THE INVENTION

It is the principal object of the invention to provide a new and improved method of reclaiming foundry sand. It is also an object of the invention to provide a new and improved apparatus for reclaiming foundry sand.

According to one facet of the invention, the foregoing objects are achieved in a method of reclaiming sand from foundry cores made up of sand and organic resin binder. The method includes the steps of:

A) reducing a foundry core made up of sand and an organic resin binder to small clumps or individual particles;

B) placing the small clumps or individual particles in a bed; and

C) introducing a heated gaseous oxidant into the bed generally from the bottom thereof in sufficient volume to fluidize the bed and at sufficient temperature to oxidize the resin binder on the small clumps or individual particles.

As a consequence of the foregoing, a relatively mechanically simple system is provided with a minimum of moving parts. Excellent heat transfer to the sand is achieved by the heated oxidant passing up through the bed of sand as it fluidizes the same. As a consequence, only a relatively small piece of equipment is required.

In a preferred embodiment, step C above is accompanied by the step of subjecting the bed to a vibratory force.

In a preferred embodiment, step B is preformed by placing the small clumps or individual particles on a conveying surface and the step of subjecting includes the step of subjecting the conveying surface to a vibratory force to cause the small clumps and the individual particles to be conveyed along the conveying surface.

In a preferred embodiment, the temperature is at least about 1,000° F. In a preferred embodiment, the oxidant is air.

A preferred method involves the steps of:

A) providing an annular, generally horizontal, vented conveying surface;

B) placing small clumps and/or individual particles of sand with an organic binder on the conveying surface;

C) imparting a vibratory force to the conveying surface to cause the sand to be conveyed around the same;

D) flowing heated air through the conveying surface in sufficient volume to form a fluidized bed of the small clumps and/or individual particles and at sufficient temperature to oxidize the organic resin binder;

E) removing the sand from the conveying surface at a level spaced above the conveying surface; and F) collecting oxidized resin from the area above the bed.

In another aspect, the invention contemplates an apparatus for reclaiming sand from the foundry cores made up of sand and an organic resin binder. The apparatus includes a perforated, generally horizonal conveying surface, means for delivering sand to be reclaimed to the conveying surface, and means for retaining the sand on the surface. A duct is provided for heated air and is in fluid communication with the perforations in the conveying surface. A heater is included for heating air to an elevated temperature sufficient to oxidize the binder and delivering the heated air to the duct. Means are provided for imparting a vibratory, conveying force to the conveying surface.

In one embodiment, an exhaust hood is placed over the conveying surface. In a preferred embodiment, the conveying surface and the retaining means are defined by an annular trough.

In a highly preferred embodiment, the duct is an annular duct and the heater is disposed centrally within the annular conveying surface. A plurality of generally radially extending ducts interconnect the heater and the annular duct. Preferably, the radially extending ducts are generally equally angularly spaced from one another.

In one embodiment, a ramp is located in the trough and extends from the conveying surface upwardly to an outlet above the intended level of sand to be reclaimed in the trough, the ramp being narrower than the trough.

Preferably, the trough extends along one side of the wall and the trough is an annular trough with the one side wall being the radially outer wall of the trough.

Other objects and advantages will become apparent from the following specification taken in connection with the accompanying drawings.

DESCRIPTION OF THE DRAWINGS

FIG. 2 is a sectional view taken approximately along the line 2—2 in FIG. 1;

FIG. 3 is a somewhat schematic developed view of components employed to generate a vibratory force.

DESCRIPTION OF THE PREFERRED EMBODIMENT

Figure 1:
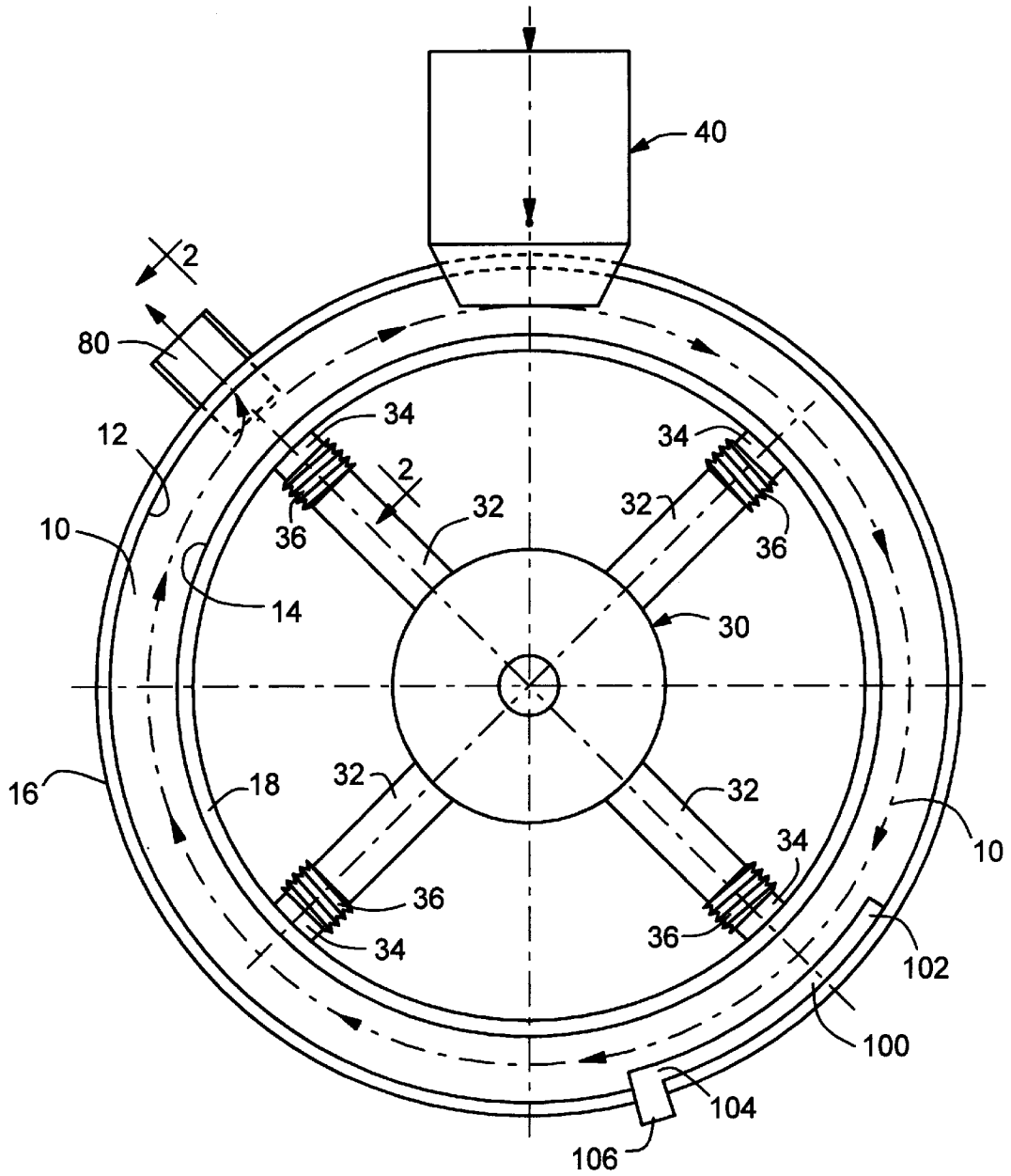
FIG. 1 is a plan view of a sand reclaiming apparatus made according to the invention, with parts removed for clarity.

An exemplary embodiment of an apparatus for reclaiming foundry sand used in forming cores made up of sand and organic resin binder is illustrated in the drawings and with reference to FIGS. 1 and 2 is seen to include a perforated annular surface 10. The surface 10 is surrounded on its radially outer side by a peripheral radially outer side wall 12 and on its inner side by a peripheral radially inner side wall 14. Both side walls 12 and 14 terminate in upper, horizonal flanges 16 and 18, respectively.

In the usual case, the perforated conveying surface 10 can be formed separately from the side walls 12 and 14 and a plurality of struts 20 extend between the walls 12 and 14 at appropriate intervals to provide for support for the conveying surface 10.

Both side walls 12 and 14 extend below the struts 20 downwardly to a surface 22. The surface 22 along with the lower portions of the side walls 12 and 14 and the conveying surface 10 define an annular duct 24 below the conveying surface 10. As can be seen in FIG. 1, a heater, generally designated 30, is located centrally within the annular conveying surface 10. The heater includes four generally radially extending ducts 32 which are of the same internal cross sectional area and which are preferably equally angularly spaced as illustrated in FIG. 1. The lower part of the side wall 14, in turn, receives a duct section 34 at each location of the duct 32 and a flexible duct section 36 interconnects the two. Thus, hot oxidant, specifically, air, may be delivered by the heater 30 to the duct or plenum 24. By reason of the equal angular spacing of the ducts 32, delivery of the air at locations within the annular duct 24 is relatively uniform.

As seen in FIG. 1, at one location about the conveying surface 10, a conventional vibratory crusher, generally designated 40, is located. Sand to be reclaimed is introduced into the vibratory crusher 40 where it is broken into small clumps and/or individual sand particles and then introduced onto the conveying surface 10.

As seen in FIG. 3, the conveying surface 10 is excited by conventional vibratory apparatus. Specifically, an electric motor 44 is suspended on a base 46 connected by any suitable means to the trough defined by the side walls 12 and 14 in the conveying surface 10. The same drives an output sheave 48 which is connected by a V belt 50 to an eccentric 52. A connecting rod 54 extends from the eccentric to be connected to a base 56 in a conventional fashion. As a consequence, upon energization of the motor 44, the trough 10 will have a vibratory, conveying force applied thereto. Also included are a series of springs 58 interposed between the base 56 and the trough including the conveying surface 10 as well as links 60 which are pivoted to the trough as at 62 and to the base as at 64. Needless to say, a plurality of these springs 58 and the links 60 will be employed.

In addition, isolation springs 66 of conventional construction extend between the trough and the base 56.

An annular hood 70 is fitted to the flanges 16 and 18 of the side walls 12 and 14 to enclose the same. The hood 70 includes an outlet port 72 which may be connected by a flexible duct 74 to an exhaust system. Insulation 76 may be disposed on both the hood 70 as well as the side walls 12 and 14 and the bottom 22 of the duct 24. The system includes a reclaimed sand outlet chute 80 shown in FIGS. 1 and 2. As can be seen, the bottom 82 of the chute is spaced above the conveying surface 10 a distance sufficient so that only individual particles, and not small clumps of sand, will exit via the chute 80.

In terms of general operation, foundry sand containing organic resin binder is fed through the vibratory crusher 40 to reduce sand to small clumps or individual particles. It is then introduced onto the conveying surface 10. The conveying surface will be subjected to a vibratory force ultimately provided by the motor 44 to convey material introduced onto the surface 10 in a clockwise direction as viewed in FIG. 1.

At the same time, hot air, preferably heated to a 1,000° F. or more, is introduced through the perforations in the conveying surface 10 to flow upwardly through the sand being conveyed thereon. The flow rate is sufficient to fluidize the entire bed of sand extending about the annular conveying surface 10. As a consequence, individual particles will move toward the top of the bed while clumps will move toward the conveying surface 10. Because of the spacing of the underside 82 of the outlet chute 80 above the conveying surface 10, only individual particles will be high enough within the bed so as to be discharged through the chute 80. Clumps will continue to circulate within the bed. During such circulation, the constant vibratory motion of the surface 10 will cause the clumps to break up and eventually become individual particles which then can be discharged through the chute 10.

The temperature of the air passed into the sand to fluidize the same will typically be sufficient so that the organic resin on the sand particles and clumps within the bed will be oxidized, i.e. combusted. With that having occurred, the individual particles can then be reused in a subsequent foundry process.

Products of combustion, i.e. the oxidized resin, is removed from the system through the duct 72. To assure complete combustion, it is usually desirable to flow sufficient air through the bed so as to provide substantially more than the stoichiometric quantity of oxygen necessary to combust the resin present on the sand.

Figure 4:
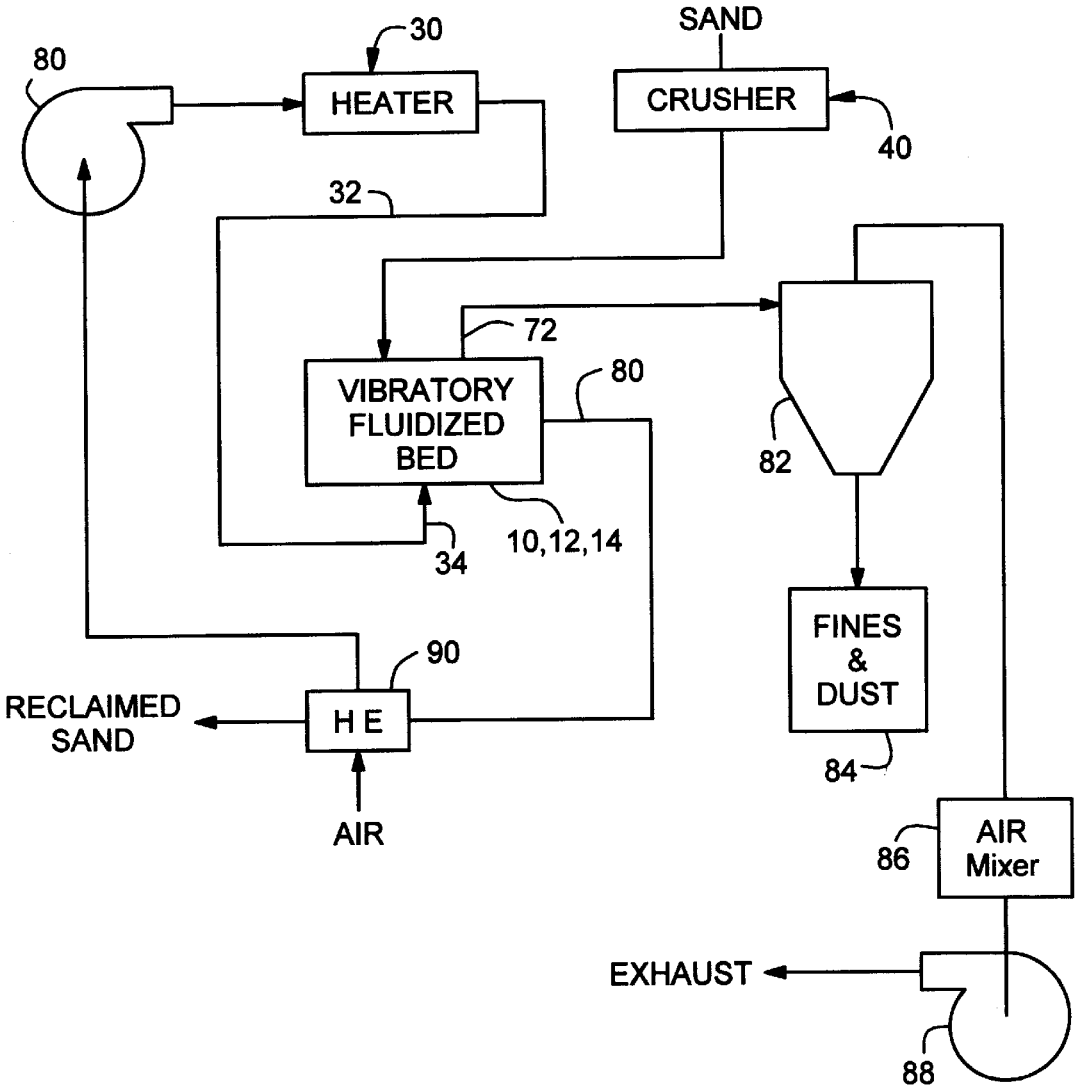
FIG. 4 is a schematic of a sand reclamation system incorporating the sand reclaiming apparatus.

FIG. 4 illustrates a complete system.

A blower 80 provides air from the ambient to the heater 30 from which it is flowed to the inlet ducts 34. From there, the heated air flows upwardly through the sand on the surface 10 to combust the resin therein. The sand, of course, has been introduced via the crusher 40 at this point in time.

Products of combustion leave through the duct 72 and enter a cyclone separator 82. Fines and dust are extracted from the airstream within the cyclone separator 82 and provided to a suitable collection apparatus 84. The exhaust airstream exiting the cyclone separator 82 is taken to an air mixer 86 where the exhaust airstream may be diluted with ambient air. This airflow is assisted by a blower 88 which then discharges the diluted products of combustion to the atmosphere, although, if environmental concerns and the nature of the process warrant it, further cleansing of the exhaust stream may be provided.

Reclaimed sand is taken from the outlet 80 to be reused. In one embodiment of the invention, the reclaimed sand from the outlet 80 is fed to a heat exchanger 90 where it is brought into contact with the inlet airstream to the blower 80. Thus, the heat from the sand 80 serves to preheat the air that will ultimately fluidize the bed to minimize fuel costs. At the same time, the sand is desirably cooled by the incoming airstream as well.

In those instances where there is concern for other foreign objects within the sand stream, such as tramp metal, means may be provided for selectively removing the same. With reference to FIG. 1, an inclined ramp 100 has a lower end 102 in the plane of the conveying surface 10 and an upper end 104 terminating in a discharge chute 106 at or above the level of the flange 16. The ramp 100 is relatively narrow and is substantially narrower than the conveying surface 10, that is, narrower than the space between the side walls 12 and 14. It is also located on the radially outer side wall 12. As a consequence, due to the circulation pattern, and the fact that the bed is fluidized causing more dense objects to sink to the bottom of the bed and less dense objects to be near the top of the bed, tramp metal will migrate toward the radially outer wall 12 on the surface 10. When it engages the ramp 100, it will move up the same, continuing to hug the wall 12 until the outlet chute 106 is encountered. At this point, it will be discharged from the system. Sand or the like encountering the ramp 100 may also pass up the ramp 10 but due to the density differences will tend to be located radially inward of the wall 12 and tumble off the radially inner edge of the ramp 10 to be returned to the trough defined by the side walls 12 and 14 and the conveying surface 10. If desired, the ramp 100 could be perforated as well so as to allow individual grains of sand to tumble through perforation in the ramp 100.

From the foregoing, it will be appreciated that a method and apparatus for reclaiming foundry sand made according to the invention is highly advantageous in a number of respects. The use of a fluidized bed in which heat transfer is accomplished is a highly efficient means of heating the resin on the sand to achieve combustion of it during the reclamation process. As a consequence, residence time can be minimized, meaning that the apparatus may be housed in a smaller space and/or process more sand in a given period of time than prior art apparatus.

Furthermore, moving parts in the system are essentially minimized as compared to those utilizing rotary drum kilns or the like, thereby providing for a mechanically simple system which is less expensive to fabricate, less costly to maintain, and less prone to failure. Of additional significance is the fact that clumps remain in the system until such time as they are broken by the vibratory forces to which they are subjected and to individual particles and rise to the top of the bed from which they may exit through the chute 80. This is made possible by the use of an annular conveying surface.

It will therefore be appreciated that the method and apparatus of the invention in fact achieve the objects set out for them and have many beneficial effects as mentioned previously.

I claim:

1. Apparatus for reclaiming sand from foundry cores made up of sand and an organic resin binder comprising:

(a) a perforated, generally horizontal conveying surface;

(b) means for delivering sand to be reclaimed to said surface;

(c) means for retaining the sand on said surface;

(d) a duct for heated air in fluid communication with the perforations in said conveying surface;

(e) a heater for heating air to an elevated temperature sufficient to oxidize said binder and deliver the heated air to said duct; and (f) means for imparting a vibratory conveying force to said surface;

said conveying surface and said retaining means being defined by an annular trough.

2. The apparatus of claim 1 further including an exhaust hood fitted to said annular trough.

3. Apparatus for reclaiming sand from foundry cores made up of sand and an organic resin binder comprising:

(a) a perforated, generally horizontal conveying surface;

(b) means for delivering sand to be reclaimed to said surface;

(c) means for retaining the sand on said surface;

(d) a duct for heated air in fluid communication with the perforations in said conveying surface;

(e) a heater for heating air to an elevated temperature sufficient to oxidize said binder and deliver the heated air to said duct;

(f) means for imparting a vibratory conveying force to said surface; said duct being an annular duct; and said conveying surface being an annular conveying surface, and said heater is disposed centrally within said annular conveying surface; and (g) a plurality of radially extending ducts interconnecting said heater and said annular duct.

4. The apparatus of claim 3 wherein said radially extending ducts are generally equally angularly spaced.

5. Apparatus for reclaiming sand from foundry cores made up of sand and an organic resin binder comprising:

(a) perforated, generally horizontal conveying surface;

(b) means for delivering sand to be reclaimed to said surface;

(c) means for retaining the sand on said surface, said retaining means and said conveying surface comprising a trough having a bottom wall and opposed side walls, and a reclaimed sand outlet in one of said side walls spaced above said conveying surface;

(d) a duct for heated air in fluid communication with the perforations in said conveying surface;

(e) a heater for heating air to an elevated temperature sufficient to oxidize said binder and deliver the heated air to said duct;

(f) means for imparting a vibratory conveying force to said surface; and (g) a ramp located in said trough and extending from said conveying surface upwardly to an outlet above the intended level of sand to be reclaimed in said trough, said ramp being narrower than said trough.

6. The apparatus of claim 5 wherein said trough extends along one of said side walls.

7. The apparatus of claim 6 wherein said trough is annular and said one side wall is the radially outer wall of said trough.

* * * * *